US005999492A

United States Patent [19]

Teixeira

[11] Patent Number: 5,999,492

[45] Date of Patent: Dec. 7, 1999

[54] CHRONOLOGICAL DISPLAY DEVICE

[76] Inventor: Martin Michael Teixeira, 2010-E So. Hannibal St., Aurora, Colo. 80013

[21] Appl. No.: 08/197,156

[22] Filed: Feb. 16, 1994

[51] Int. Cl.[6] ..... G04B 47/00; G04B 19/24; G04C 17/00

[52] U.S. Cl. ..... 368/10; 368/29; 368/223

[58] Field of Search ..... 368/10, 28, 29, 368/41–43, 82–84, 107–109, 223, 228, 239–242

[56] References Cited

U.S. PATENT DOCUMENTS

| | | | |
|---|---|---|---|
| 4,005,571 | 2/1977 | Wolff | 368/28 |
| 4,193,255 | 3/1980 | Ebihara et al. | 368/34 |
| 4,303,995 | 12/1981 | Aizawa | 368/28 |
| 4,531,841 | 7/1985 | Puff | 368/63 |
| 4,630,935 | 12/1986 | Zettek | 368/41 |
| 4,831,605 | 5/1989 | Suga | 368/113 |
| 4,895,393 | 1/1990 | Shimizu | 281/30 |
| 4,964,072 | 10/1990 | Nara et al. | 364/705.08 |
| 4,989,025 | 1/1991 | Matsumura et al. | 354/106 |
| 4,991,156 | 2/1991 | Suga | 368/113 |
| 5,022,016 | 6/1991 | Smith et al. | 368/223 |
| 5,031,161 | 7/1991 | Kendrick | 368/280 |
| 5,058,085 | 10/1991 | Lawler | 368/28 |
| 5,216,642 | 6/1993 | Bikkers | 368/10 |

FOREIGN PATENT DOCUMENTS

| | | | |
|---|---|---|---|
| 1-141392 | 6/1989 | Japan | G04F 10/00 |
| 1-203991 | 8/1989 | Japan | G04F 10/00 |

*Primary Examiner*—Vit Miska
*Attorney, Agent, or Firm*—Thomas J. Loran

[57] ABSTRACT

A chronological display device depicting a displayed event and a continuous time display informing the viewer of continuous time intervals from the unchanging event to the present time or the remaining time to a future unchanging event.

12 Claims, 2 Drawing Sheets

CHRONOLOGICAL DISPLAY DEVICE

BACKGROUND OF THE INVENTION

1. Field of the Invention

The present invention is generally directed to a chronological display device that couples a continuous time display with a visual depiction of an event and continuously informs a viewer of time interval from the unchanging depicted event to present time, or remaining time to a future unchanging depicted event.

2. Description of Prior Art

Electronic and mechanical time pieces having the capability to measure and display lapse time from a starting time have been available for many years. These electronic devices use liquid crystal displays or analog display faces of time measurement to indicate lapse time or alternatively to start a signal when a particular time arrives. Mechanical devices are also used with or without some electronics. The only reference is time—lapsed seconds, minutes, hours, days, months and years measured from starting time to present time.

Some time pieces may record more than one event, such as explained in U.S. Pat. Nos. 4,630,935 and 4,303,995. These devices indicate a plurality of dates and relate elapsed time from a starting time of each date or time. All such time devices relate to calendar dates, time periods, and numerical relationships of beginning and ending elapse times.

The original event from which the elapse time is measured is known only to the operator of the time piece. Others observing the time piece have no reference to the starting event or time. The actual event that the referred elapse time measures must be stored separately in human memory, computers, notes, or note books. For long elapsed time periods of months or years, or when a plurality of times are recorded, remembering or finding the relationship of an elapse time indicator to an event becomes difficult.

A camera with an elapsed time indicator (U.S. Pat. No. 4,989,025) photographs a current event. This camera records the event but cannot display the picture. The developed picture does not display continually elapsing time. Additional photographs do not indicate the unchanging first event and only record a fixed and unchanging elapsed time.

Many people display reminders of significant events in their lifetimes to recall achievements, honors, and pleasant events. These include photographs and certificates of marriages, graduations, professional achievements, child births, vacations etc. However these displays of the unchanging event do not reflect the increasing time to make the viewer aware of the continual passing of time or approaching time for a future depicted event. People striving to complete work before a future time event occasionally and mentally calculate remaining times but are not always aware of periods of time remaining to complete a task. This especially happens when many projects are pursued at the same time.

The present invention depicts important unchanging events with an associated continuing time indicator that will immediately and visually remind the viewer of the event, indicate time interval from the event, and continue on in perpetual relation to the displayed event. If the depicted event is in the future, the present invention indicates and reminds the user of the time remaining to the important depicted event to assist future planning and scheduling.

SUMMARY OF THE INVENTION

The present invention generally relates to a chronological display device that will visually and continually indicate to the viewer an accumulating or reducing time interval related to a depicted event. This chronological display device provides the viewer with immediate knowledge of the appropriate time span of the chronological measuring device related to an event without referring separately to the time indicator or to the reason the time measurement is being employed. The time interval reference relates to the depicted event and not the normal solar reference of time.

The chronological display device couples the depicted event with a chronological timing device having a visual numerical time display. This provides the viewer with a constant reminder of significant events relative to changing time intervals to assist planning or recall the time intervals from pleasant or pertinent memories.

The chronological display device may also have included visual or audible signaling devices programmed for future times to alert the viewer of important times related to the depicted event. The chronological display device is capable of numerically measuring and displaying seconds, minutes, hours, days, weeks, months, or years separately or in any combination.

The chronological display device may be a video monitor with an unchanging depicted event displayed with the changing chronological time interval display where a computer or semiconductor microchips are programmed to indicate time intervals from past depicted events or remaining time to future depicted events.

Accordingly, one object of the invention is to visually inform or remind the viewer of continuous time intervals between a past event depicted on the device and the present time.

Another object of the invention is to visually inform or remind the user of continuous remaining time intervals between the present time and a future depicted event.

Another object of the invention is to provide programming of visual, audible, or visual and audible signals for future time alerts or reminders related to the depicted event.

Another object of the invention is to provide palpable reference of time intervals related to a palpably depicted event to inform or remind sightless people.

Another object of the invention is to use a video monitor as the chronological display device with a computer or semiconducter microchips providing the continuous relative time intervals from the present to past or future depicted unchanging events.

DETAILED DESCRIPTION OF THE PREFERRED EMBODIMENTS

Figure 1:
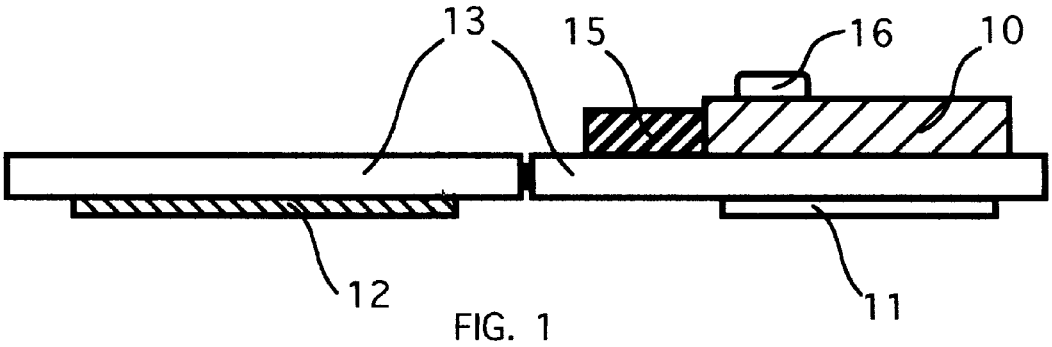
FIGS. 1 and 2 indicate top and front views of a chronological display device that visually couples a chronological time device having a continuous display of time intervals with a past depicted event or a future depicted event.
Figure 2:
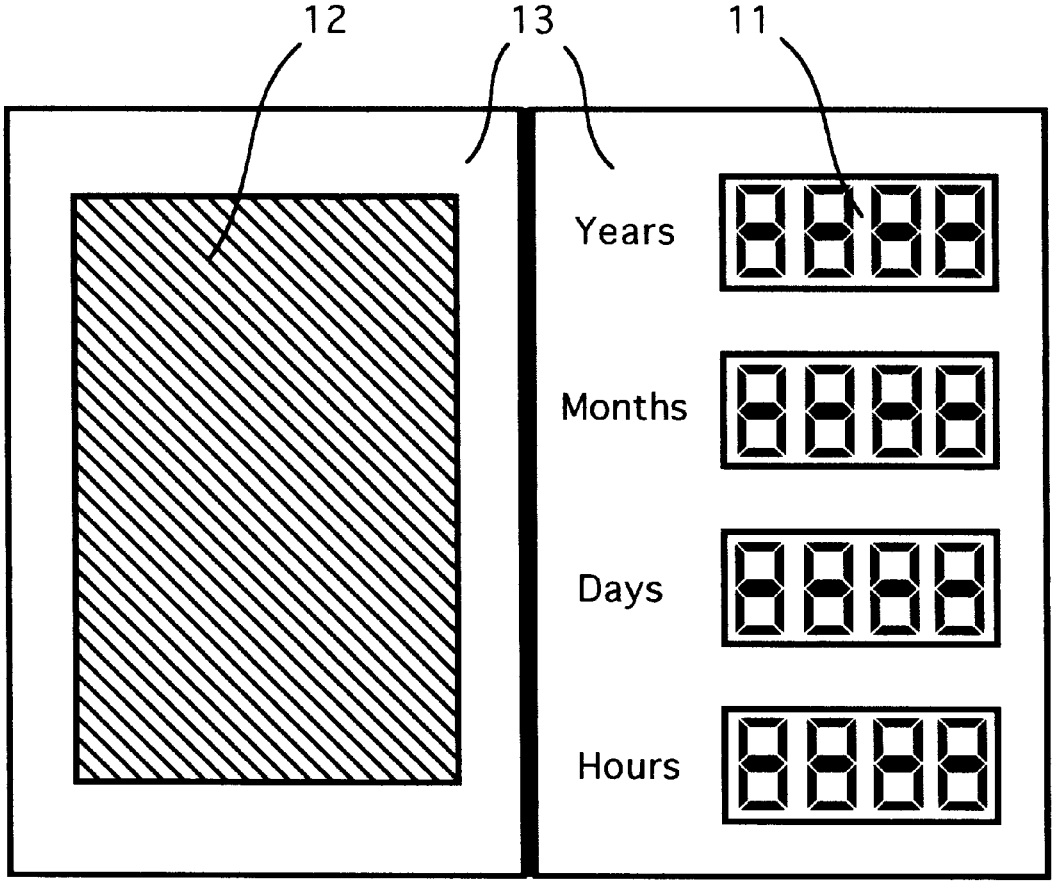
Figure 3:
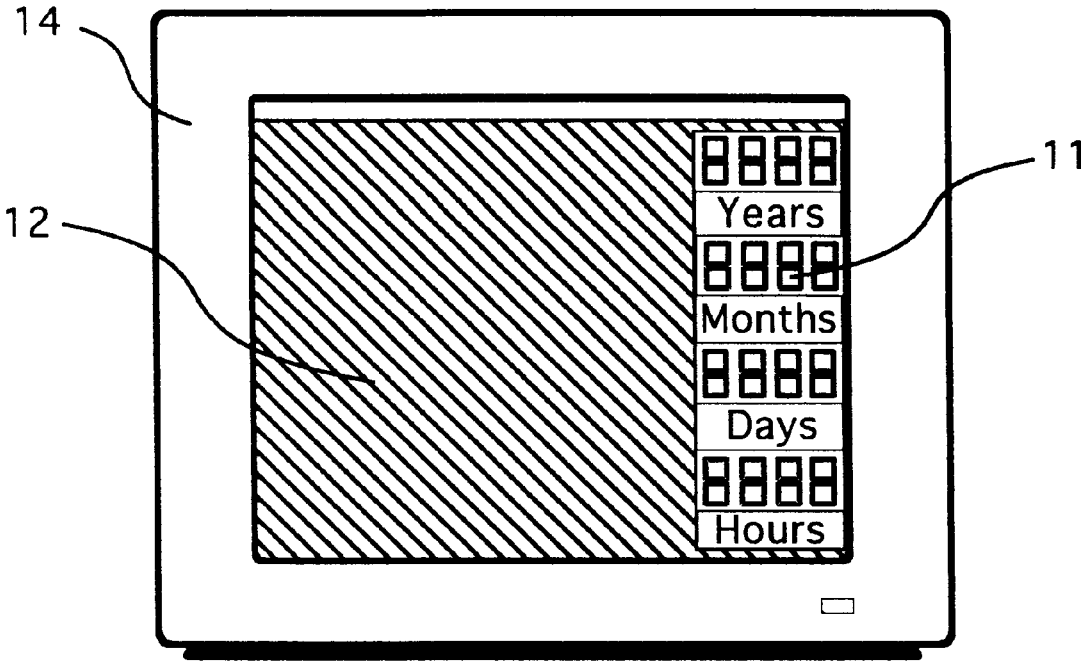
FIG. 3 indicates using a video monitor as a chronological display device.

The present invention of a chronological display device that will continually indicate to the viewer an accumulating or reducing time period related to a depicted event is shown in top view, FIG. 1, and front view, FIG. 2. This chronological display device couples in the same front view, FIG. 2, a continuing display of time intervals 11, a depicted event 12, on a means 13 of displaying and supporting the chronological time display with the depicted event. Located in conjunction with the time display 11 is a chronological measuring device 10 shown in top view, FIG. 1. Also shown in FIG. 1 is a means 15 for setting a time for a signal and a signal means, and a means 16 for activating an alarm indicating low power supply. FIG. 3 shows the present invention of a chronological display device as a video monitor 14, displaying an unchanging depicted event 12 on the video monitor coupled with a chronological display 11 of changing time intervals.

The chronological time device is designed to measure time intervals including seconds, minutes, hours, weeks, months, and years individually or in any combination. The type of chronological measuring device, chemical, mechanical, or electronic, used in the invention in the broadest sense is meant as a device to measure and indicate accumulating or reducing time periods. Some of these chronological time devices are described in U.S. Pat. Nos. 4,193,255, 4,303,995, 4,831,605, 4,964,072, 4,989,025, and 4,991,156. Japanese Patents JA 1-141392 and JA 1-203991 also describe chronological devices. The devices that include designs having a means for compensating variations of days in a month and leap years while maintaining correct time intervals are preferred.

The continuous interval time display may be combined with the chronological device as shown on the above referenced patents or be a separate component provided with time interval information from the chronological measuring device. When the chronological measuring device is measuring intervals from a past depicted event, the accumulating time is shown on the display. When the chronological device is measuring time to a future depicted event, the remaining time is shown. The chronological display device has a means to set a start or ending solar time by the user.

The chronological devices in addition to measuring time intervals contain functions including, a means for continuing operation in the event of any power failure, a means to compensate for changing time zones or daylight savings times, and a means to initiate and stop an audio signal, a visual signal, a palpable signal or both an audio and visual signal. Chronological device power sources may be chemical, alternating or direct electrical current or mechanical power devices, individually or combined. A means to signal low power may be included with battery driven power sources.

The time interval display should be coordinated with the chronological time device to display time intervals of seconds, minutes, hours, days, weeks, months and years individually or in any combination. The time interval display may be numerical, graphic or text. Time interval display devices use liquid crystal displays or analog display faces of time measurement to indicate time intervals but are not limited to these display methods. Preferably the time interval display is continual although there may be included a means to mask the display on demand without affecting the time intervals. The time display may have an option of being lighted. Descriptive time word units such as hours, days, weeks, months, or years are optional on the appropriate time division display.

The depicted event includes but is not limited to events, words, themes, awards, licenses, patents, diplomas, photographs, maps, projects, goals, documents, sentences, deadlines, or any information relating to time in the past or future. These past events could also include but not be limited to depicting weddings, births, vacations, anniversaries, assemblies, photographs, or employment. Future events may include depicting program or project deadlines, patent application deadlines, patent expirations, retirements, end of incarcerations, end of military service, graduation dates, vacation times, or goals. The time associated with the occurrence of the event may be displayed together with the event.

The means for displaying the chronological time display and the depicted event may include but not be limited to a single frame, plaque, planar or curved surface, or joined sections of these means. The chronological display device could be attached to a wall, displayed on surfaces, made into jewelry, or adapted to any other object. The means for displaying the chronological device, may be constructed from but not limited to plastic, glass, crystal, stone, metal, wood, clay, paper, or combinations of these materials.

A single display means may include a plurality of chronological display devices, each having respective depicted events and displayed time intervals.

In this present invention the above descriptive words of depicted, visual, and display are intended for people having sight. For sightless people, "by palpable methods" should be applied after "depicted", "display", and "visual". The time interval display may also have a continuing audible time interval message relating to the depicted event.

A video monitor may be the chronological display device. If used with a computer, the depicted event can be scanned from a photograph, document, or any other source, and maintained on the video monitor. For a computer monitor, the depicted event can be maintained in memory with the appropriate continuing interval time display. The coupled depicted event with appropriate continually changing time on the same screen can be shown as "wall paper" or the "desk top" during computer operation to make the computer user aware of desired time intervals. Available computer software programs such as "Super Clock"® and others can be programmed to determine and show time intervals relating to said event. These time intervals may be selected to increase in time from a past event to present changing time or continually decrease in time from present time to a future depicted event.

Semiconductor microchips may also be used in the present invention of a chronological display device for determining time intervals, displaying time intervals, and related depicted events. The time interval display and depicted event could be shown on video monitors or other chronological display devices.

The chronological display device is activated by depicting an event on the display and entering a solar time for the event in the time measuring device. The current is then entered. The desired time intervals such as minutes, hours, days, and years or any singular time or combination of times are selected and the interval time measuring device started. The time display indicates continuing time intervals relating to the depicted event.

From the above description of the invention, various changes and modifications on the device will occur to those skilled in the art. All such modifications coming within the scope of the appended claims are intended to be included therein:

What I claim:

1. A chronological display device comprising:

(a) a means for visually depicting an unchanging event, (b) a means for continually displaying time intervals relating to said depicted event time, said time intervals selected to increase in time from a past said depicted event time or said time intervals selected to decrease in time from present time to a future said depicted event time, (c) said time intervals are provided by a means for continuously measuring said time intervals and, (d) a means for mounting said means for measuring said time intervals with said means for displaying said time intervals and said means for visually depicting said event.

2. A chronological display device according to claim 1 wherein said means for continuously measuring said time intervals is combined with said means for displaying said time interval.

3. A chronological display device according to claim 1 wherein said means for continuously measuring said time intervals and displaying said time intervals includes electronic devices.

4. A chronological display device according to claim 1 wherein said means for measuring said time intervals is capable of measuring desired seconds, minutes, hours, days, weeks, months, and years as determined.

5. A chronological display device according to claim 1 wherein said means for displaying time intervals also displays said depicted event time.

6. A chronological display device according to claim 1 wherein said means for measuring said time intervals includes an actuator means for setting a time relating to said depicted event and current time.

7. A chronological display device according to claim 1 wherein said means for continuously measuring said time intervals includes a means for setting a time for signal wherein said signal is selected from a group consisting of acoustical, visual, and palpable.

8. A chronological display device according to claim 1 wherein said means for continuously measuring said time intervals includes a means for activating an alarm indicating low power supply.

9. A chronological display device according to claim 1 wherein said means for continuously measuring said time intervals includes a means for adjusting said time interval when time error occurs.

10. A chronological display device according to claim 1 wherein said means for continually displaying said time intervals and said means for visually depicting an event includes palpable methods.

11. A chronological display device according to claim 1 wherein said means for mounting provides for a plurality of said chronological display devices.

12. A chronological display device according to claim 1 wherein said means for mounting includes materials selected from a group consisting of plastic, glass, crystal, metal wood, clay, rock, and paper.

* * * * *